US009187219B2

(12) United States Patent
Brannon et al.

(10) Patent No.: US 9,187,219 B2
(45) Date of Patent: Nov. 17, 2015

(54) POUR LIP CLOSURE WITH DRAIN BACK

(71) Applicant: MWV Slatersville, LLC, Slatersville, RI (US)

(72) Inventors: Patrick J. Brannon, Warwick, RI (US); Clifford W. Skillin, Blackstone, MA (US); Gordana K. Giguere, North Smithfield, RI (US)

(73) Assignee: WestRock Slatersville, LLC, Norcross, GA (US)

( * ) Notice: Subject to any disclaimer, the term of this patent is extended or adjusted under 35 U.S.C. 154(b) by 0 days.

(21) Appl. No.: 13/786,665

(22) Filed: Mar. 6, 2013

(65) Prior Publication Data

US 2014/0252034 A1 Sep. 11, 2014

(51) Int. Cl.

| | |
|---|---|
| ***B65D 47/40*** | (2006.01) |
| ***B65D 23/06*** | (2006.01) |
| ***B65D 47/08*** | (2006.01) |

(52) U.S. Cl.

CPC ..... *B65D 47/40* (2013.01); *B65D 23/06* (2013.01); *B65D 47/0838* (2013.01)

(58) Field of Classification Search

CPC ..... B65D 47/40; B65D 23/06; B65D 23/065
USPC ..... 222/109, 111, 543, 556
See application file for complete search history.

(56) References Cited

U.S. PATENT DOCUMENTS

| | | | | |
|---|---|---|---|---|
| 1,749,253 | A * | 3/1930 | Levy | 222/109 |
| 2,025,406 | A * | 12/1935 | Whelan | 215/41 |
| 3,168,221 | A * | 2/1965 | Parker | 222/109 |
| 3,208,650 | A | 9/1965 | Ham | |
| 3,307,752 | A * | 3/1967 | Anderson | 222/465.1 |
| 4,298,145 | A * | 11/1981 | Iida | 222/478 |
| 4,917,268 | A | 4/1990 | Campbell et al. | |
| 5,141,138 | A * | 8/1992 | Odet et al. | 222/153.07 |
| 5,251,788 | A * | 10/1993 | Moore | 222/111 |
| 5,462,202 | A | 10/1995 | Haffner et al. | |
| 5,850,953 | A | 12/1998 | Dallas, Jr. | |
| 5,855,299 | A * | 1/1999 | Arnold et al. | 222/109 |
| 5,875,942 | A | 3/1999 | Ohmi et al. | |
| 6,109,487 | A | 8/2000 | Hashimoto | |
| 6,367,670 | B1 | 4/2002 | Warner et al. | |
| 6,464,106 | B1 | 10/2002 | Giblin et al. | |
| 6,474,514 | B1 * | 11/2002 | Guillemin et al. | 222/475.1 |
| 6,659,310 | B1 * | 12/2003 | Wolpert | 222/109 |
| 6,923,341 | B2 | 8/2005 | Smith | |

(Continued)

FOREIGN PATENT DOCUMENTS

| | | | |
|---|---|---|---|
| JP | 2000025821 | A | 1/2000 |

*Primary Examiner* — Daniel R Shearer
(74) *Attorney, Agent, or Firm* — Barlow, Josephs & Holmes, Ltd.

(57) ABSTRACT

A closure with a drain back for a container of liquids is disclosed. The closure includes a closure body having an upper deck. A skirt depends from the upper deck and is configured to secure to a neck of a container. An inner annular wall depends from the upper deck within the skirt. The inner wall has a downwardly sloped bottom wall with an edge forming an opening therethrough, forming a drain back for liquid into the container. A tubular spout extends from the bottom wall. The spout has a dispensing orifice. The spout and dispensing orifice configured for fluid communication with the container to dispense liquids therefrom. The closure may further include a sealing cap connected to the closure body via a living hinge.

1 Claim, 5 Drawing Sheets

(56) References Cited

U.S. PATENT DOCUMENTS

| | | | | |
|---|---|---|---|---|
| 7,390,453 | B2 * | 6/2008 | Brecheisen et al. | 264/524 |
| 7,686,188 | B2 | 3/2010 | Stebick et al. | |
| 7,870,980 | B2 | 1/2011 | Wilson et al. | |
| 2005/0145655 | A1 | 7/2005 | Giblin et al. | |
| 2007/0095864 | A1 * | 5/2007 | Vangeel et al. | 222/556 |
| 2011/0284541 | A1 * | 11/2011 | Webster et al. | 220/288 |
| 2012/0043295 | A1 * | 2/2012 | Webster et al. | 215/44 |
| 2013/0075414 | A1 * | 3/2013 | Van Geel et al. | 220/834 |

* cited by examiner

POUR LIP CLOSURE WITH DRAIN BACK

BACKGROUND OF THE INVENTION

1. Field of the Invention

The present patent document relates generally to dispensing closures for bottles containing liquids and more particularly to a closure having a spout with a pour lip and a drain back to minimize spillage.

2. Background of the Related Art

Containers that hold liquids to be dispensed on demand can have the disadvantage of creating messes when the liquid contained therein drips down the side of the container after being dispensed. Consumer products, like vegetable oil and the like, can be especially messy. Consumers must frequently wipe down the container after use to prevent the liquid from making a mess. Therefore, there is a need in the art for a closure that prevents drips from running down the side of the container.

SUMMARY OF THE INVENTION

The present invention solves the problems of the prior art by providing a closure with a drain back. The closure includes a closure body having an upper deck. A skirt depends from the upper deck and is configured to secure to a neck of a container. An inner annular wall depends from the upper deck within the skirt. The inner wall has a downwardly sloped bottom wall with an edge forming an opening therethrough, forming a drain back for liquid into the container. A tubular spout extends from the bottom wall. The spout has a dispensing orifice. The spout and dispensing orifice configured for fluid communication with the container to dispense liquids therefrom. The closure may further include a sealing cap connected to the closure body via a living hinge.

The spout may further have a pour lip extending from a leading edge of the spout, configured to draw drips against the spout as the container is turned upright, thereby funneling drips back down into the container.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
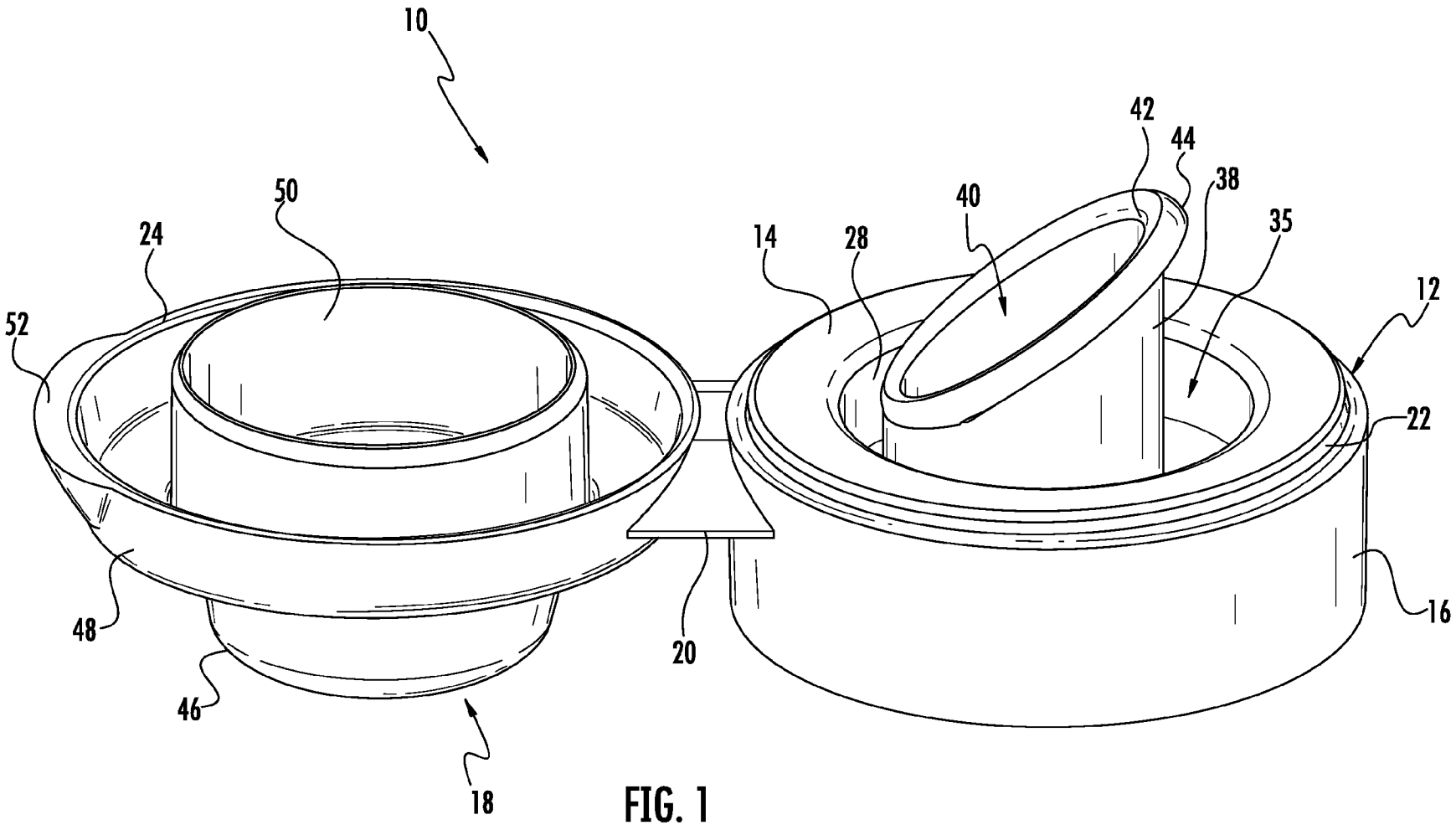
FIG. 1 is a top perspective view of the closure with the cap open.
Figure 2:
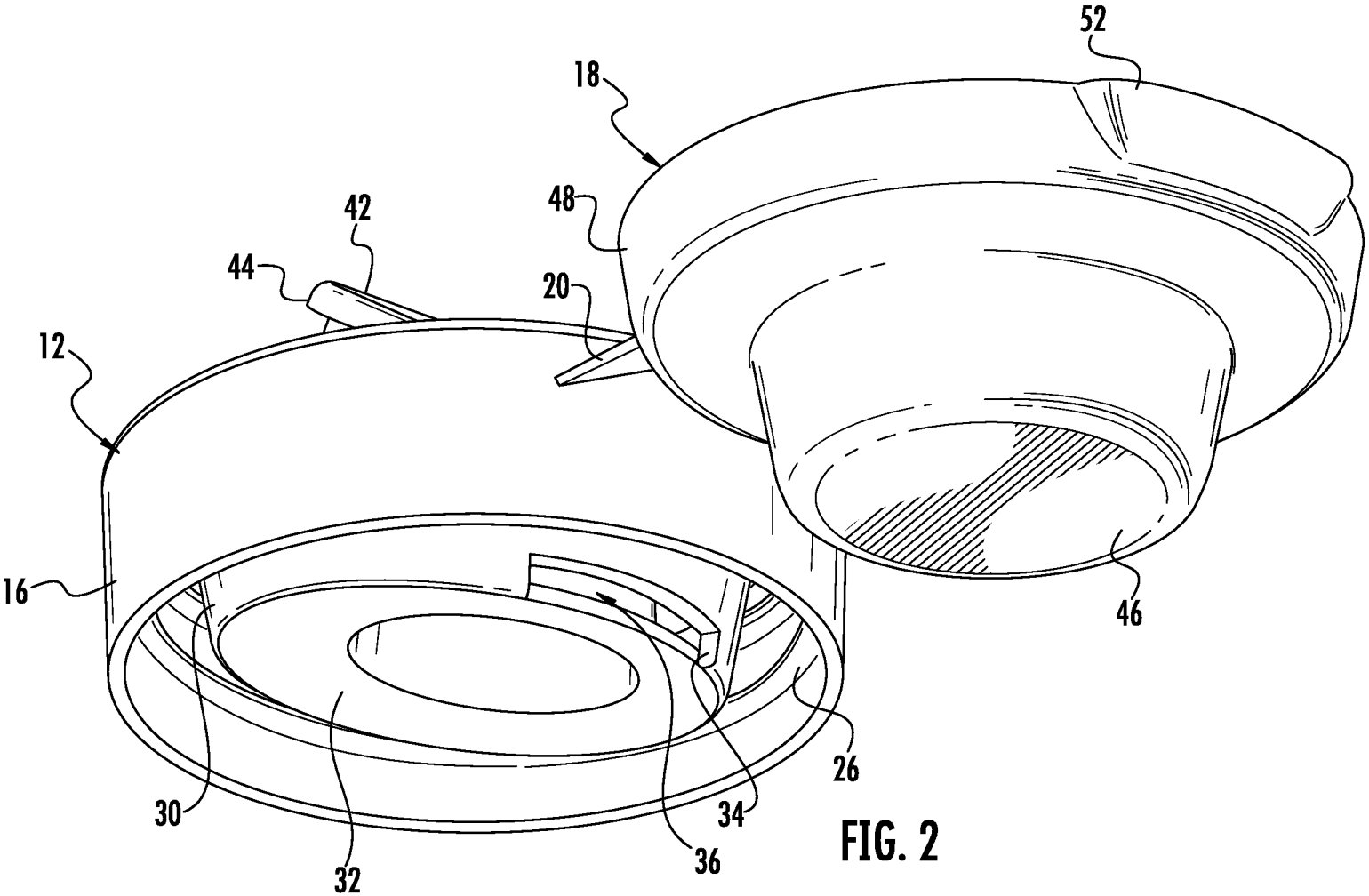
FIG. 2 is is a bottom perspective view of the closure.

Referring now to FIG. 1-5, the closure is shown generally at 10. The closure includes a closure body 12 having an upper deck 14 with a depending skirt 16. A cap 18 is connected to the closure body 12 via a living hinge 20, which is configured to close the closure 10 when not in use (best seen closed in FIG. 4). A recessed annular wall 22 is formed on the upper deck 14 to receive an outer peripheral edge 24 of the cap 18. The skirt 16 is configured to attach to a neck of a container (not shown), for instance, by threads 26 (best seen in FIGS. 3 and 5).

An inner annular wall 28 depends from the upper deck 14, inwards of the skirt 16. The inner wall 28 may be angled or tapered inwardly, becoming narrower towards a bottom end 30. A bottom wall 32 is connected to the inner annular wall 28, forming a cup-shaped area 35 inside the closure body 12. The bottom wall 32 is pitched or sloped downwardly towards one side. An edge 34 is formed on the inner annular wall 28 and/or bottom wall 32, defining an opening 36 therethrough, forming the drain back from the cup-shaped area 35. Fluids collecting in the cup-shaped area 35 will drain through the opening 36 and back into the container.

Extending from the bottom wall 32 is a cylindrical or tubular spout 38, having a dispensing orifice 40. The dispensing orifice 40 and spout 38 are in fluid communication with the container when the closure 10 is mounted thereto. The dispensing orifice 40 of the spout 38 is preferably angled with a leading edge 42 extending in the direction intended for pouring liquids, and a trailing edge adjacent the drain back opening 36. A pour lip 44 extends from the leading edge 42 of the spout. The pour lip 44, via a capillary action, draws drips against the spout 38 when the container is turned upright after pouring, funneling the drips back down into the cup-shaped area 35, to the bottom wall 32, and, eventually, to the opening 36, where the liquid drains back into the container.

Figure 3:
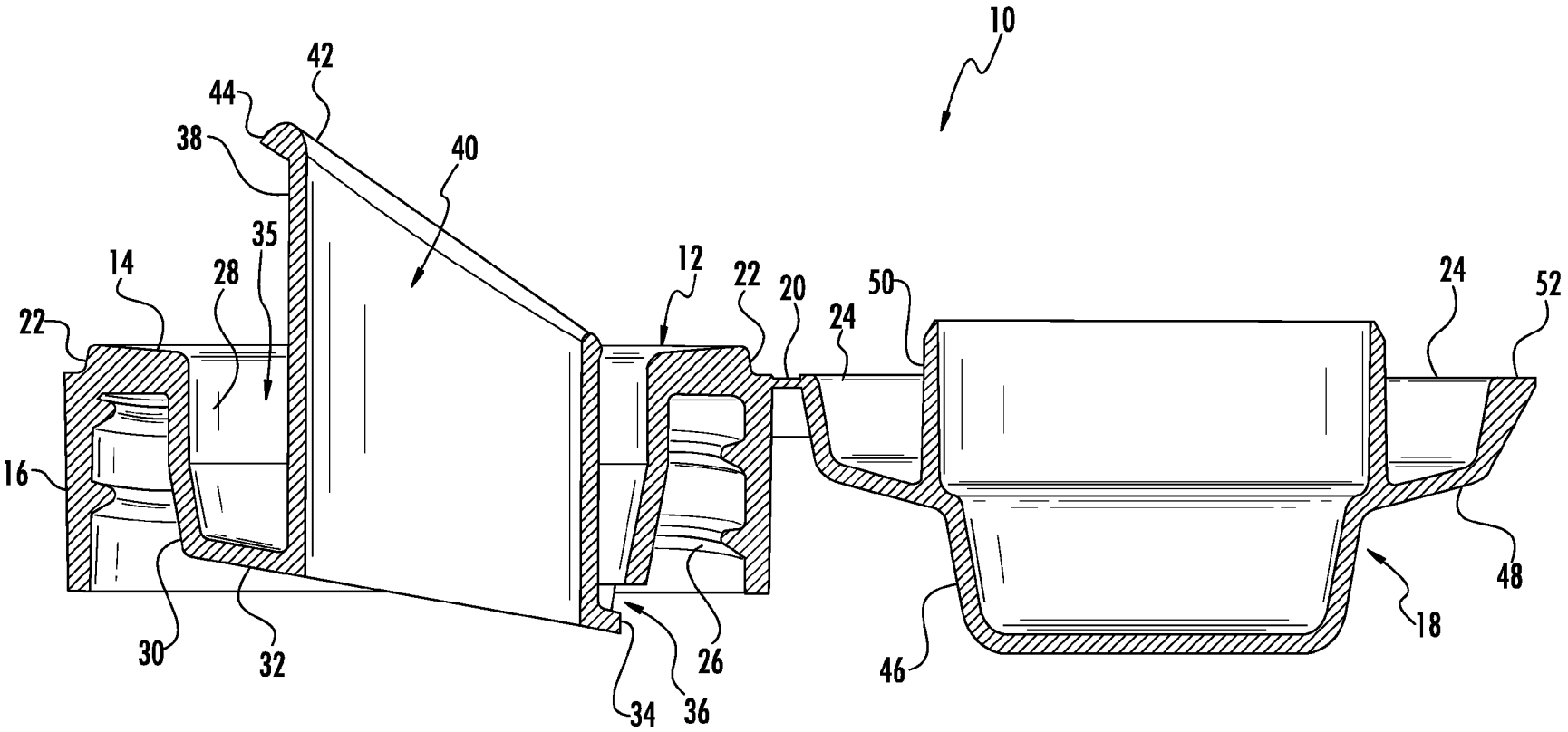
FIG. 3 is a cross-section view through line 3-3 of FIG. 1.
Figure 4:
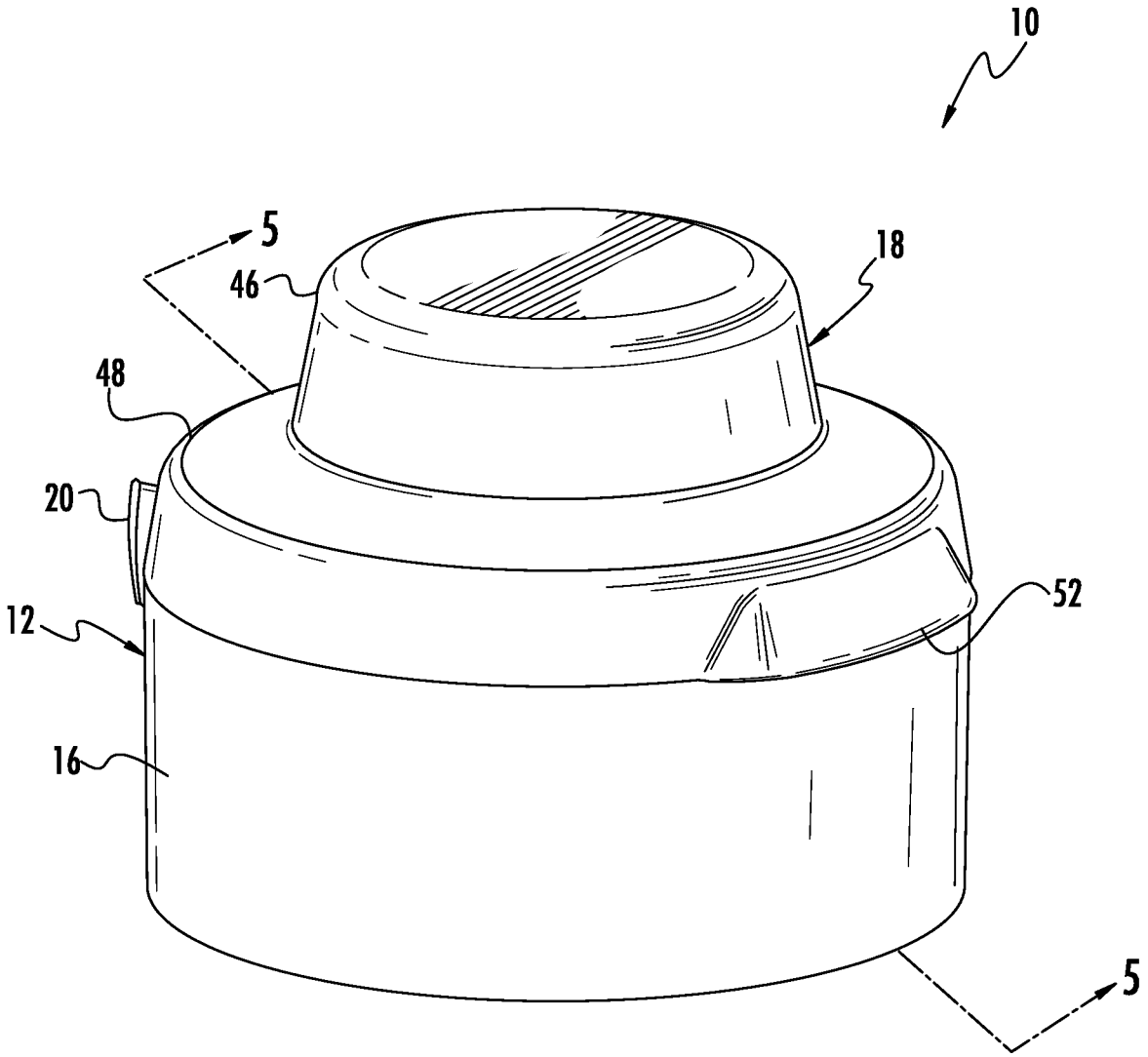
FIG. 4 is a top perspective view of the closure with the cap closed.
Figure 5:
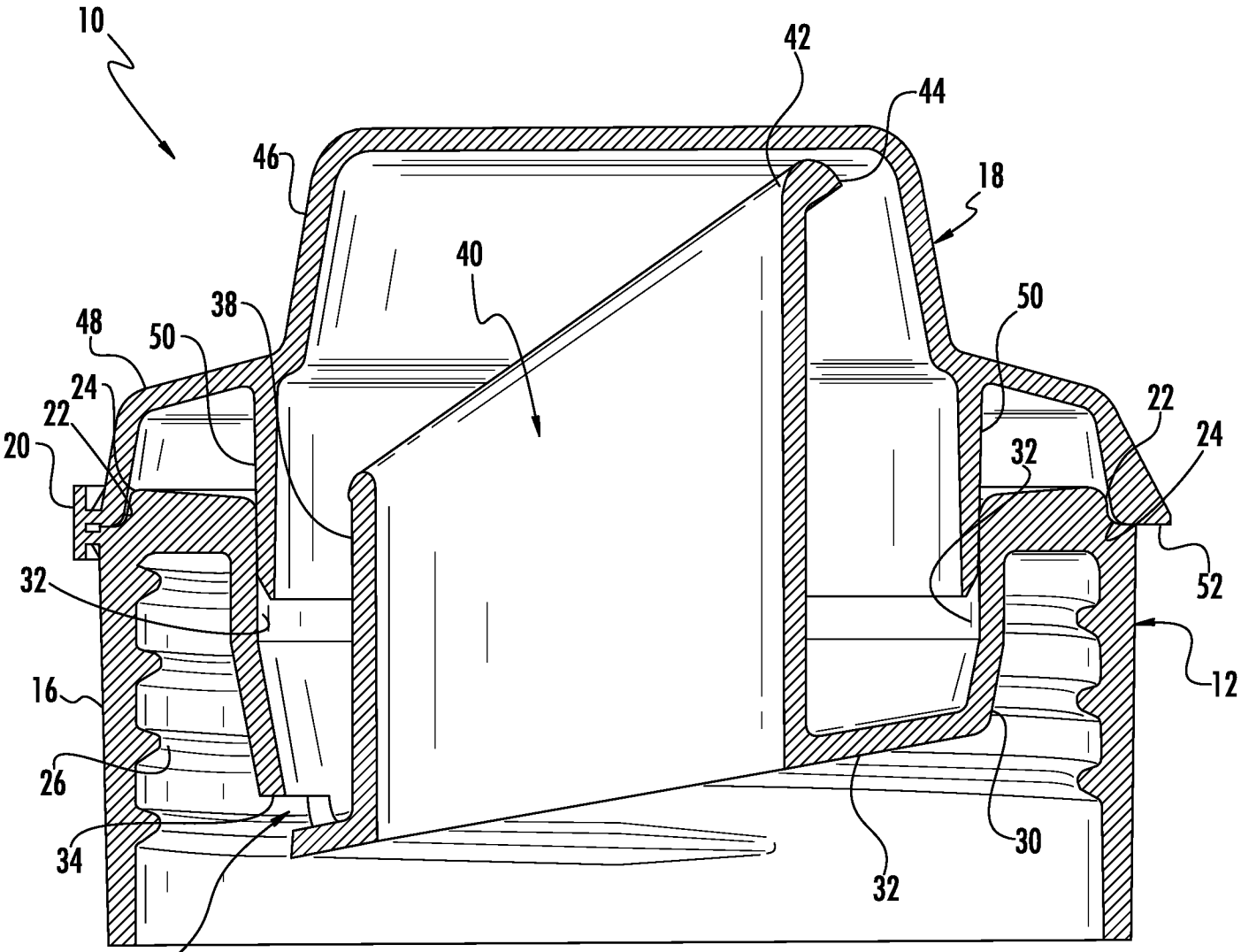
FIG. 5 is a cross-section view through line 5-5 of FIG. 4.

As clearly seen in FIG. 3, the bottom wall 32 is sloped downwardly from the leading edge of the spout 38 towards the trailing edge and towards the drain back opening 36. As is also clearly seen in FIG. 3, the tubular spout 38 is concentrically offset from a central axis of the closure body 12 rearwardly towards the drain back opening 36 forming a narrower cup-shaped area adjacent the trailing edge, thereby funneling liquid collected in the cup-shaped area 35 to the drain back opening 36.

The cap 18 is connected to the closure body 12 via a living hinge 20. The cap 18 may be moved between an open position, allowing dispensing, and a closed, position, sealing closure 10 and the container. The cap 18 includes a top portion 46, which covers the spout 38 when closed, and a peripheral skirt 48 depending therefrom. The peripheral skirt 48 has an outer peripheral edge 24 that contacts the recessed annular wall 22 on the closure body 12 when the cap 18 is closed, thereby presenting a uniform and aesthetically pleasing appearance.

An annular sealing wall 50 depends from an inner surface of the cap 18. The annular sealing wall 50 is configured to contact the inner wall 28 of the closure body 12 in sealing engagement, preventing liquid from exiting the container if the container is inadvertently tipped over. The cap 18 may include a thumb catch 52 depending from the outer peripheral skirt 48 to assist in opening the cap 18.

Therefore, it can be seen that the present invention provides a unique solution to the problem of providing a closure that prevent spillage. The consumer dispenses product from the container and through the closure as normal. However, when the user uprights the container, drips on the spout that would normally run off the closure body and down the sidewall of the container, are instead funneled back down into the container.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A closure, comprising:

a closure body having an upper deck, a skirt depending from the upper deck configured and arranged to secure to a neck of a container, a cap connected to the closure body via a living hinge, the cap configured and arranged for sealing engagement with the closure body;

an inner annular wall depending from the upper deck within the skirt, the inner wall having a bottom wall, a tubular spout extending upwardly from the bottom wall, the spout comprising an unbroken cylindrical wall having an upper lip with leading edge and a trailing edge, the spout being configured for fluid communication with the container to dispense liquids therefrom, said inner wall, said spout and said bottom wall cooperating to form a cup-shaped area for collecting fluids, said bottom wall being downwardly sloped from the leading edge of the spout to the trailing edge thereof, said upper lip of the spout being downwardly angled from the leading edge of the spout to the trailing edge of the spout thereby forming an elliptical shape, said inner wall having an opening therethrough adjacent the trailing edge of the spout, said opening forming a drain back opening for collected liquids to reenter the container, said tubular spout being concentrically offset from a central axis of said closure towards said drain back opening whereby said cup-shaped area is narrower adjacent said drain back opening thereby funneling collected liquid to said drain back opening; and a pour lip extending from a leading edge of the spout, the pour lip having an angled surface connecting said leading edge to an outside surface of the tubular spout, whereby when the container is turned upright, the pour lip and angled surface cause drips to draw against the outside surface of the tubular spout via capillary action, funneling them to the drain back and into the container, the pour lip having a rounded surface extending from the leading edge to the angled surface to facilitate said capillary action.

* * * * *